US005948125A

United States Patent [19]

Ouziel

[11] Patent Number: 5,948,125

[45] Date of Patent: Sep. 7, 1999

[54] METHOD OF TREATING DYED, NATURAL OR SYNTHETIC POLYAMIDE FIBRE MATERIALS

[75] Inventor: Philippe Ouziel, Altkirch, France

[73] Assignee: Ciba Specialty Chemicals Corporation, Tarrytown, N.Y.

[21] Appl. No.: 09/075,635

[22] Filed: May 11, 1998

[30] Foreign Application Priority Data

May 20, 1997 [CH] Switzerland ..... 1171/97

[51] Int. Cl.[6] ..... D06P 1/52; D06M 15/285; D06M 15/227

[52] U.S. Cl. ..... 8/552; 8/554; 8/917; 8/924; 8/553

[58] Field of Search ..... 8/552, 553, 554, 8/917, 924

[56] References Cited

U.S. PATENT DOCUMENTS

| | | | |
|---|---|---|---|
| 2,844,597 | 7/1958 | Guenthard et al. | 260/372 |
| 5,092,905 | 3/1992 | Dor´´ | 8/638 |
| 5,094,665 | 3/1992 | Mäuseyahl | 8/641 |
| 5,131,919 | 7/1992 | Mäuseyahl | 8/643 |
| 5,234,467 | 8/1993 | Schaetzer | 8/641 |
| 5,417,724 | 5/1995 | Pacifici et al. . | |
| 5,460,630 | 10/1995 | Ouziel et al. . | |
| 5,527,889 | 6/1996 | Schaetzer et al. | 534/829 |
| 5,630,851 | 5/1997 | Jordine et al. | 8/641 |
| 5,650,497 | 7/1997 | Adam et al. | 534/829 |
| 5,653,772 | 8/1997 | Mori et al. . | |
| 5,691,459 | 11/1997 | Adam et al. | 534/829 |
| 5,725,606 | 3/1998 | Jordine | 8/641 |

FOREIGN PATENT DOCUMENTS 9-324373 12/1997 Japan .

*Primary Examiner*—Margaret Einsmann
*Attorney, Agent, or Firm*—Kevin T. Mansfield; David R. Crichton

[57] ABSTRACT

A method of fixing dyes on natural or synthetic polyamide fiber material, wherein the fiber material is treated, before, during or after dyeing, with a liquor comprising a homo- or co-polymer having structural repeating units of at least one of formulae (1), (2) and (3)

(1)

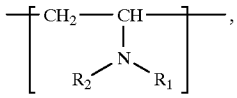

(2)

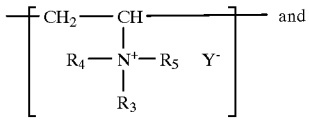

and (3)

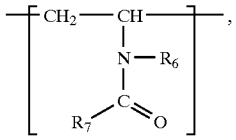

wherein the variables are as defined in the claims.

The resulting dyeings and prints are distinguished by improved fastness to wetting, without the shade and the fastness to light being affected, and by improved fastness to ozone.

21 Claims, No Drawings

METHOD OF TREATING DYED, NATURAL OR SYNTHETIC POLYAMIDE FIBRE MATERIALS

The present invention relates to a method of treating dyed, natural or synthetic polyamide fibre materials in order to improve fastness properties.

Dyeings and prints using dyes often exhibit inadequate fastness to wetting, especially fastness to washing and to water. The dye, which is bonded to the surface of the polyamide fibre, may be removed by repeated washing and taken up again by an adjacent textile material that is being washed in the same washing operation. This shortcoming is generally counteracted by carrying out after the dyeing process an aftertreatment using a fixing agent based on phenol-formaldehyde condensates. The known fixing agents have disadvantages, however; for example they may be insufficiently effective or they may have an adverse effect on other fastness properties, for example fastness to light. There is therefore a need for improved fixing agents for the treatment of dyed, natural or synthetic polyamide fibre materials, especially those dyed using anionic dyes, that do not have the mentioned disadvantages.

It has now been found that the fastness to wetting of, for example, dyeings of anionic dyes on polyamide fibre material can be improved, without other fastness properties being adversely affected, if they are subjected to a treatment with certain homo- or co-polymers.

The present invention therefore relates to a method of fixing dyes on natural or synthetic polyamide fibre materials, wherein the fibre material is treated, before, during or after dyeing, with a liquor comprising a homo- or co-polymer having structural repeating units of at least one of formulae (1), (2) and (3)

(1)

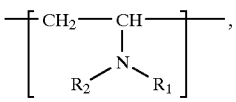

(2)

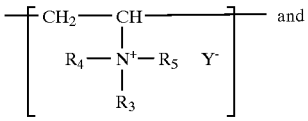

and (3)

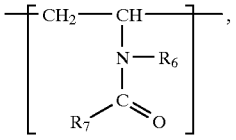

wherein $R_1$, $R_2$, $R_3$, $R_4$ and $R_6$ are each independently of the others hydrogen; $C_1$–$C_6$alkylsulfonyl; unsubstituted or substituted phenyl; benzoyl or phenylsulfonyl each unsubstituted or substituted in the phenyl ring; or a $C_1$–$C_{12}$alkyl radical that is unsubstituted or substituted by hydroxy, carboxy, cyano, carbamoyl, a radical —CONH-(alk)-T, N,N-di-$C_1$–$C_4$alkylcarbamoyl,

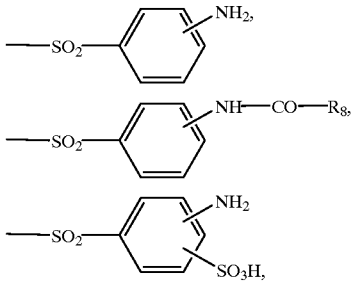

amino or by a radical —$NHR_9$, —$N(R_9)_2$, —$N(R_9)_3^+Y^-$ or —COO-(alk)-T, (alk) is a straight-chain or branched $C_1$–$C_{10}$alkylene radical, T is hydrogen or a radical —$NH_2$, —$NHR_9$, —$N(R_9)_2$ or —$N(R_9)_3^+Y^-$, $R_8$ and $R_9$ are $C_1$–$C_6$alkyl and $Y^-$ is an anion, $R_5$ is hydrogen or benzyl or has one of the meanings indicated above for $R_1$, $R_2$, $R_3$, $R_4$ and $R_6$ as a $C_1$–$C_{12}$alkyl radical, and $R_7$ is hydrogen or $C_1$–$C_4$alkyl.

$R_1$, $R_2$, $R_3$, $R_4$ and $R_6$ as $C_1$–$C_6$alkylsulfonyl are each independently of the others, for example, methylsulfonyl, ethylsulfonyl, n- or iso-propylsulfonyl, n-, iso- or sec-butylsulfonyl, straight-chain pentylsulfonyl or hexylsulfonyl, preferably methylsulfonyl or ethylsulfonyl and especially methylsulfonyl.

$R_1$, $R_2$, $R_3$, $R_4$ and $R_6$ as phenyl are unsubstituted or substituted, for example, by halogen, e.g. chlorine or bromine; hydroxy; sulfamoyl; carbamoyl; sulfo; carboxy; $C_1$–$C_4$alkyl, e.g. methyl, ethyl, n- or iso-propyl, n-, iso-, sec- or tert-butyl, preferably methyl or ethyl; $C_1$–$C_4$alkoxy, e.g. methoxy, ethoxy, n- or iso-propoxy, n-, iso-, sec- or tert-butoxy, preferably methoxy or ethoxy; amino or $C_2$–$C_7$alkanoylamino, preferably $C_2$–$C_4$alkanoylamino, e.g. acetylamino, propionylamino or butyrylamino, especially acetylamino. Preferably the phenyl ring is unsubstituted.

The meanings and preferences indicated for halogen, $C_1$–$C_4$alkyl, $C_1$–$C_4$alkoxy and $C_2$–$C_7$alkanoylamino apply also to the correspondingly substituted benzoyl and phenylsulfonyl radicals $R_1$, $R_2$, $R_3$, $R_4$ and $R_6$ listed below.

$R_1$, $R_2$, $R_3$, $R_4$ and $R_6$ as benzoyl are unsubstituted or substituted in the phenyl ring, for example, by halogen, hydroxy, sulfamoyl, carbamoyl, sulfo, carboxy, $C_1$–$C_4$alkyl, $C_1$–$C_4$alkoxy, amino or by $C_2$–$C_7$alkanoylamino. Preferably the benzoyl radical is unsubstituted or substituted in the phenyl ring by $C_1$–$C_4$alkyl, $C_1$–$C_4$alkoxy, amino or by $C_2$–$C_4$alkanoylamino. The benzoyl radical is especially unsubstituted.

$R_1$, $R_2$, $R_3$, $R_4$ and $R_6$ as phenylsulfonyl are unsubstituted or substituted in the phenyl ring, for example, by halogen, hydroxy, sulfamoyl, carbamoyl, sulfo, carboxy, $C_1$–$C_4$alkyl, $C_1$–$C_4$alkoxy, amino or by $C_2$–$C_7$alkanoylamino. Preferably the phenylsulfonyl radical is unsubstituted or substituted in the phenyl ring by $C_1$–$C_4$alkyl, $C_1$–$C_4$alkoxy, amino or by $C_2$–$C_4$alkanoylamino.

As $C_1$–$C_{12}$alkyl there come into consideration for $R_1$, $R_2$, $R_3$, $R_4$, $R_5$ and $R_6$, each independently of the others, for example, methyl, ethyl, n- or iso-propyl, n-, iso-, sec- or tert-butyl or straight-chain pentyl, hexyl, heptyl, octyl, nonyl, decyl, undecyl and dodecyl, it being possible for each of those alkyl radicals to carry one or more of the substituents mentioned above, which may be identical or different. $R_1$, $R_2$, $R_3$, $R_4$, $R_5$ and $R_6$ as $C_1$–$C_{12}$alkyl are each independently of the others preferably a $C_1$–$C_6$alkyl radical that is unsubstituted or substituted as indicated above, especially a $C_1$–$C_4$alkyl radical that is unsubstituted or substituted as indicated above. In the case of $R_5$, the $C_1$–$C_4$alkyl radical is preferably unsubstituted. In a particular embodiment of the present invention, $R_1$, $R_2$, $R_3$, $R_4$ and $R_6$ as $C_1$–$C_4$alkyl are substituted as indicated above.

$R_7$ as $C_1$–$C_4$alkyl is, for example, methyl, ethyl, n- or iso-propyl, n-, iso-, sec- or tert-butyl, preferably methyl or ethyl and especially methyl.

$R_8$ and $R_9$ as $C_1$–$C_6$alkyl are each independently of the other, for example, methyl, ethyl, n- or iso-propyl, n-, iso-, sec- or tert-butyl or straight-chain or branched pentyl or hexyl, preferably $C_1$–$C_4$alkyl, especially methyl or ethyl and more especially methyl.

$Y^-$ may be any anion, for example sulfate or halide. $Y^-$ is preferably a halide anion, for example the bromide ion $Br^-$ or especially the chloride ion $Cl^-$.

$C_1$–$C_{10}$Alkylene (alk) is, for example, methylene, ethylene or straight-chain or branched propylene, butylene, pentylene, hexylene, heptylene, octylene, nonylene or decylene. The radical (alk) is preferably straight-chain or branched $C_1$–$C_6$alkylene, e.g. methylene, 1,1- or 1,2-ethylene, 1,2- or 1,3-propylene or straight-chain or branched butylene, pentylene or hexylene, and is especially $C_1$–$C_4$alkylene.

T is hydrogen or a radical —$NH_2$, —$NHR_9$, —$N(R_9)_2$ or —$N(R_9)_3{}^+Y^-$, wherein $R_9$ and $Y^-$ are each subject to the meanings and preferences mentioned above. Preferably T is hydrogen or a radical —$NH_2$, —$NHR_9$, —$N(R_9)_2$ or —$N(R_9)_3{}^+Y^-$ wherein $R_9$ is methyl or ethyl and $Y^-$ is a halide ion. T is more especially a radical —$N(R_9)_2$ or —$N(R_9)_3{}^+Y^-$ wherein $R_9$ is methyl or ethyl, especially methyl, and $Y^-$ is the bromide or chloride anion.

When the radicals $R_1$, $R_2$, $R_3$, $R_4$ and $R_6$ are phenylsulfonyl substituted in the phenyl ring by amino or by $C_2$–$C_7$alkanoylamino, the amino group or the $C_2$–$C_7$alkanoylamino group is bonded, for example, in the o- or m-position relative to the sulfo group or preferably in the p-position relative to the sulfo group.

When the radicals $R_1$, $R_2$, $R_3$, $R_4$, $R_5$ and $R_6$ are $C_1$–$C_{12}$alkyl substituted by

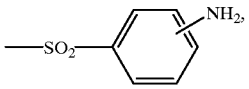

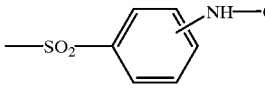

or by

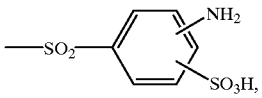

the amino group or the —NH—CO—$R_8$ group is bonded, for example, in the o- or m-position relative to the sulfo group or preferably in the p-position relative to the sulfo group, $R_8$ being subject to the meanings and preferences mentioned above.

Preferably, $R_1$, $R_2$, $R_3$, $R_4$ and $R_6$ are each independently of the others hydrogen; phenyl that is unsubstituted or substituted by halogen, sulfo, $C_1$–$C_4$alkyl, $C_1$–$C_4$alkoxy, amino or by $C_2$–$C_4$alkanoylamino; benzoyl or phenylsulfonyl each unsubstituted or substituted in the phenyl ring by halogen, $C_1$–$C_4$alkyl, $C_1$–$C_4$alkoxy, amino or by $C_2$–$C_4$alkanoylamino; or a $C_1$–$C_6$alkyl radical that is unsubstituted or substituted by hydroxy, carboxy, cyano, carbamoyl, a radical —CONH-(alk)-T,N,N-di-$C_1$–$C_4$alkylcarbamoyl,

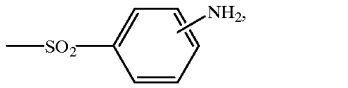

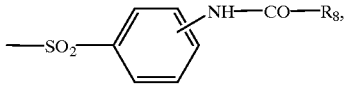

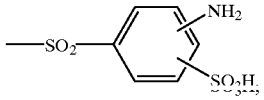

amino or by a radical —$NHR_9$, —$N(R_9)_2$, —$N(R_9)_3{}^+Y^-$ or —COO-(alk)-T, wherein (alk) is $C_1$–$C_4$alkylene, T is as defined above, $R_8$ and $R_9$ are $C_1$–$C_4$alkyl and $Y^-$ is a halide anion.

Especially, $R_1$, $R_2$, $R_3$, $R_4$ and $R_6$ are each independently of the others hydrogen; phenyl that is unsubstituted or substituted by halogen, $C_1$–$C_4$alkyl or by $C_1$–$C_4$alkoxy; benzoyl or phenylsulfonyl each unsubstituted or substituted in the phenyl ring by $C_1$–$C_4$alkyl, $C_1$–$C_4$alkoxy, amino, acetylamino or by propionylamino; or a $C_1$–$C_4$alkyl radical that is unsubstituted or substituted by hydroxy, carboxy, cyano, a radical —CONH—$(CH_2)_{1-3}$-T,

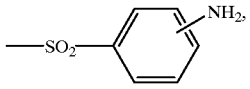

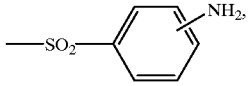

amino or by a radical —$NHR_9$, —$N(R_9)_2$, —$N(R_9)_3{}^+Y^-$ or —COO—$(CH_2)_{1-3}$-T, wherein T is as defined above, $R_9$ is methyl or ethyl and $Y^-$ is a halide anion.

More especially, $R_1$, $R_2$, $R_3$, $R_4$ and $R_6$ are each independently of the others hydrogen; phenyl; benzoyl or phenylsulfonyl each unsubstituted or substituted in the phenyl ring by methyl, ethyl, amino or by acetylamino; methyl; ethyl; hydroxy-$C_1$–$C_2$alkyl; carboxy-$C_1$–$C_2$alkyl; cyano-$C_1$–$C_3$alkyl;

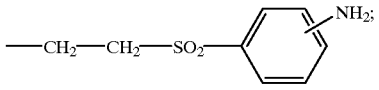

$(R_9)_2N$-$C_1$–$C_3$alkyl; $Y^-(R_9)_3N^+$-$C_1$–$C_3$alkyl; or a radical of formula $$—CH_2—CH(OH)—(CH_2)_{1-2}\text{-T}, \quad (4a)$$

$$—CH_2—CH(R_{10})—COO—(CH_2)_{1-3}-T, \quad (4b)$$

or $$—CH_2—CH(R_{10})—CONH—(CH_2)_{1-3}-T \quad (4c),$$

wherein

T is hydrogen, $—N(R_9)_2$ or $—N(R_9)_3{}^+Y^-$, $R_9$ is methyl or ethyl, $R_{10}$ is hydrogen or methyl and $Y^-$ is a bromide or chloride anion.

Especially important meanings for $R_1$, $R_2$, $R_3$, $R_4$ and $R_6$, each independently of the others, are hydrogen, benzoyl, phenylsulfonyl, 4-aminophenylsulfonyl, 4-acetylaminophenylsulfonyl, $—CH_2—CH_2—COO—(CH_2)_{1-2}—CH_3$, $—CH_2—CH_2—COOH$, $—CH_2—CH_2—OH$, $—CH_2—CH_2—CN$,

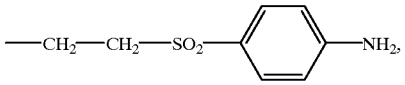

$—CH_2—CH_2—N(CH_3)_2$ and $—CH_2—CH_2—N^+(CH_3)_3Y^-$, wherein $Y^-$ is a bromide or chloride anion.

An especially important meaning for $R_2$ and $R_4$ is hydrogen.

In a special embodiment of the present invention, $R_1$, $R_3$ and $R_6$ have the meanings and preferences indicated above and are not hydrogen.

$R_5$ is preferably hydrogen, benzyl or $C_1$–$C_4$alkyl, especially hydrogen, methyl or ethyl, more especially hydrogen or methyl.

Preferred for the method according to the invention are homo- or co-polymers wherein $R_1$, $R_3$ and $R_6$ are each independently of the others hydrogen, benzoyl, phenylsulfonyl, 4-aminophenylsulfonyl, 4-acetylaminophenylsulfonyl, $—CH_2—CH_2—COO—(CH_2)_{1-2}—CH_3$, $—CH_2—CH_2—COOH$, $—CH_2—CH_2—OH$, $—CH_2—CH_2—CN$,

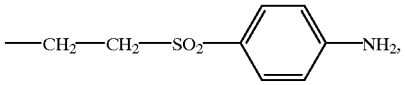

$—CH_2—CH_2—N(CH_3)_2$ or $—CH_2—CH_2—N^+(CH_3)_3Y^-$, $Y^-$ is a bromide or chloride anion, $R_2$ and $R_4$ are hydrogen and $R_5$ is hydrogen, benzyl or $C_1$–$C_4$alkyl, preferably hydrogen, methyl or ethyl, especially hydrogen or methyl.

Preferred for the method according to the invention are homo- or co-polymers comprising structural repeating units of at least one of formulae (1) and (2), wherein $R_1$, $R_2$, $R_3$, $R_4$, $R_5$ and $Y^-$ have the meanings and preferences indicated above.

Homo- and co-polymers used according to the invention as fixing agents, comprising repeating structures of the afore-mentioned formulae (1), (2) and (3) wherein the meanings of $R_1$, $R_3$ and $R_6$ are identical and $R_2$ and $R_4$ have identical meanings can be prepared, for example, by polymerising N-vinylformamide or N-vinylacetamide and optionally further copolymerisable monomers and then hydrolysing the product, and subjecting the free amino groups of the resulting homo- or co-polymer to an alkylation reaction with an alkyl halide $R_1—X_1$ and optionally $R_2—X_2$ and $R_5—X_5$, wherein $R_1$, $R_2$ and $R_5$ are each as defined above and $X_1$, $X_2$ and $X_5$ are each independently of the others a halide anion, preferably the bromide or chloride ion. Instead of the alkylation reaction with a suitable alkyl halide, it is also suitable to react the amino groups of the homo- or co-polymer with a suitable epoxide or with a double-bond-containing unsaturated compound.

Homo- and co-polymers used according to the invention as fixing agents, comprising repeating structures of the afore-mentioned formulae (1), (2) and (3) wherein $R_2$, $R_4$, $R_5$ and $R_7$ are hydrogen and the meanings of $R_1$, $R_3$ and $R_6$ are identical can advantageously be prepared also by polymerising a suitable vinylformamido compound that corresponds, for example, to formula (4)

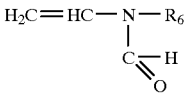

(4)

wherein $R_6$ is as defined above, and then subjecting the product to acidic or alkaline hydrolysis.

When the polymer used according to the invention is a copolymer, the following copolymerisable monomers are suitable, for example: allylamine or diallylamine derivatives, e.g. diallylamine, N-methyldiallylamine, N-ethyldiallylamine, N,N-dimethyldiallylammonium chloride; monomers having a carboxy function, e.g. (meth) acrylic acid, maleic acid, fumaric acid, itaconic acid, mesaconic acid, citraconic acid, vinylacetic acid, vinyloxyacetic acid, vinylpropionic acid, crotonic acid, aconitic acid, allylacetic acid, allyloxyacetic acid, α,β-dimethylacrylic acid, allylmalonic acid, allyloxymalonic acid, methylenemalonic acid, 2-hydroxy(meth)acrylic acid, 2-halo(meth)acrylic acid , α-ethyl acrylic acid, acrylamidoglycolic acid, glutaconic acid, β-carboxyethyl acrylate, allyloxy-3-hydroxybutanoic acid or allylsuccinic acid; or nitrogen-containing and non-ionic comonomers, e.g. N-vinylpyrrolidone, N-vinylformamide, N-vinylacetamide, N-vinyl-N-methylformamide, N-vinyl-N-methyl-acetamide, N-vinyl-N-ethyl-acetamide, N-vinylimidazole, N-vinyl-N-methyl-imidazole, N-vinylimidazoline, N-vinyl-2-methylimidazoline, N-vinylcaprolactam, vinyl acetate, vinyl propionate, vinyl butyrate, $C_1$–$C_{22}$alkylvinyl ketone, $C_1$–$C_{22}$alkylvinyl ethers, olefins (ethylene, propylene, isobutene), 1,2-dimethoxyethylene, hydroxy-$C_2$–$C_4$alkyl-(meth)acrylate, (meth)acrylic acid $C_1$–$C_{22}$alkyl esters, (meth)acrolein, (meth)acrylonitrile, (meth)acrylamide, N-mono-/N,N-di-$C_1$–$C_{10}$alkyl-(meth)acrylamide, ($C_1$–$C_4$)alkoxy-(meth) acrylates, and N,N-di-$C_1$–$C_2$alkylamino-$C_1$–$C_4$alkyl-(meth) acrylates in the form of the salts or in quaternised form, suitable quaternising agents being, for example, dimethy/ethyl sulfate, methyl/ethyl chloride and benzyl chloride.

Preferred as copolymerisable monomers in the fixing agents according to the invention are allylamine or diallylamine derivatives, (meth)acrylic acid, maleic acid, N-vinylpyrrolidone, N-vinylformamide, N-vinylacetamide, N-vinyl-N-methyl-formamide, N-vinyl-N-methyl-acetamide, N-vinyl-N-ethyl-acetamide, N-vinylimidazole, vinyl acetate, vinyl propionate, hydroxy-$C_2$–$C_4$alkyl-(meth) acrylate, (meth)acrylic acid $C_1$–$C_{22}$alkyl esters, acrylonitrile, methacrylonitrile, acrylamide, methacrylamide, N-mono-/N,N-di-$C_1$–$C_{10}$alkyl-(meth) acrylamide and N,N-di-$C_1$–$C_2$alkylamino-$C_2$–$C_4$alkyl- (meth)acrylates in the form of the salts or in quaternised form, suitable quaternising agents being, for example, dimethylethyl sulfate, methyl/ethyl chloride and benzyl chloride.

Especially preferred as copolymerisable monomers in the fixing agents according to the invention are acrylic acid, methacrylic acid, acrylonitrile, methacrylonitrile, N-vinylpyrrolidone, N-vinylformamide, N-vinylacetamide, N-vinyl-N-methyl-formamide, N-vinyl-N-methyl-acetamide, N-vinyl-N-ethyl-acetamide, N-vinylimidazole, vinyl acetate, acrylamide, methacrylamide and N-mono- or N,N-di-$C_1$–$C_4$alkyl-(meth)acrylamide.

More especially preferred as copolymerisable monomers in the fixing agents according to the invention are N-vinylpyrrolidone, N-vinylformamide, N-vinylacetamide, N-vinyl-N-methyl-formamide, N-vinyl-N-methyl-acetamide, N-vinyl-N-ethyl-acetamide, N-vinylimidazole, vinyl acetate, acrylamide, methacrylamide and N-mono- or N,N-di-$C_1$–$C_4$alkyl-(meth)acrylamide.

Preferred embodiments of the polymers used according to the invention as fixing agents relate to:

(i) homo- or co-polymers containing from 5 to 100 mol % structural repeating units of formulae (1a) and (1b)

(1a)

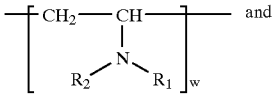

and (1b)

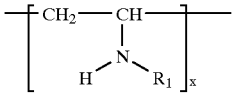

and from 95 to 0 mol % structural repeating units of formulae (5) and (6)

(5)

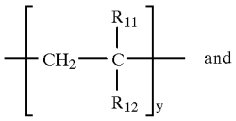

and (6)

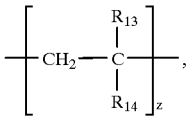

$R_1$ and $R_2$ have the meanings and preferences indicated above, $R_{11}$ and $R_{13}$ are each independently of the other hydrogen or methyl and $R_{12}$ and $R_{14}$ are each in dependently of the other 2-pyrrolidon-1-yl, amino, N-methylamino, N-ethylamino, —NH—CHO, —NH—CO—$CH_3$, —N($CH_3$)—CHO, —N($CH_3$)—CO—$CH_3$, —N($C_2H_5$)—CO—$CH_3$, imidazol-1-yl, —O—CO—$CH_3$, —CO—$NH_2$, —CO—NH($CH_3$) or —CO—N$(CH_3)_2$ and w, x, y and z are integers equal to or greater than 1 or are the number 0, the condition Q=from 0.05 to 1 applying to the quotient $$Q = \frac{w + x}{w + x + y + z}.$$

The quotient Q is defined by the ratio of the structural units of formulae (1a) and (1b) to the total number of all structural units in the copolymer. The total number of all structural units in the copolymer is derived from the sum of the structural units of the formulae (1a), (1b), (5) and (6).

Preferably, $R_1$ and $R_2$ in the homo- or co-polymers defined in detail under (i) above are each independently of the other hydrogen, methyl, ethyl, hydroxy-$C_1$–$C_2$alkyl, carboxy-$C_1$–$C_2$alkyl, cyano-$C_1$–$C_3$alkyl, $(R_9)_2N$—$C_1$–$C_3$alkyl, $Y^-(R_9)_3N^+$-$C_1$–$C_3$alkyl, or a radical of formula $$—CH_2—CH(OH)—(CH_2)_{1\text{-}2}\text{-}T, \quad (4a)$$

$$—CH_2—CH(R_{10})—COO—(CH_2)_{1\text{-}3}\text{-}T, \quad (4b)$$

or $$—CH_2—CH(R_{10})—CONH—(CH_2)_{1\text{-}3}\text{-}T \quad (4c),$$

wherein

T is hydrogen, —N$(R_9)_2$ or —N$(R_9)_3{}^+Y^-$, $R_9$ is methyl or ethyl, $R_{10}$ is hydrogen or methyl and $Y^-$ is a bromide or chloride anion.

Especially, $R_1$ and $R_2$ in the homo- or co-polymers defined in detail under (i) above are each independently of the other hydrogen, —$CH_2$—$CH_2$—COO—$(CH_2)_{1\text{-}2}$—$CH_3$, —$CH_2$—$CH_2$—COOH, —$CH_2$—$CH_2$—OH, —$CH_2$—$CH_2$—CN, —$CH_2$—$CH_2$—N$(CH_3)_2$ or —$CH_2$—$CH_2$—$N^+(CH_3)_3Y^-$, wherein $Y^-$ is a bromide or chloride anion.

More especially, $R_1$ and $R_2$ in the homo- or co-polymers defined in detail under (i) above have identical meanings.

In an important embodiment of the present invention, the homo- or co-polymers defined in detail under (i) above contain from 20 to 100 mol % structural repeating units of formulae (1a) and (1b) and from 80 to 0 mol % structural repeating units of formulae (5) and (6), the condition Q=from 0.2 to 1 applying to the quotient Q.

In an especially important embodiment of the present invention, the homo- or co-polymers defined in detail under (i) above contain from 40 to 100 mol % structural repeating units of formulae (1a) and (1b) and from 60 to 0 mol % structural repeating units of formulae (5) and (6), the condition Q=from 0.4 to 1 applying to the quotient Q.

When w in the homo- or co-polymers defined in detail under (i) is the number 0, preferred copolymers are those containing from 20 to 80 mol % structural repeating units of formula (1b) and from 80 to 20 mol % structural repeating units of formulae (5) and (6), the condition Q=from 0.2 to 0.8 applying to the quotient Q.

(ii) homo- or co-polymers comprising structural repeating units of at least one of formulae (7) and (8)

(7)

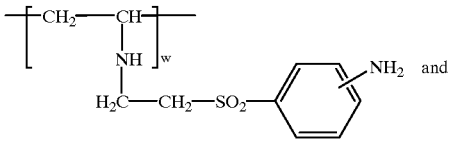

and (8)

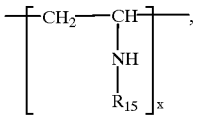

wherein $R_{15}$ is phenyl or is benzoyl or phenylsulfonyl each unsubstituted or substituted in the phenyl ring by methyl, ethyl, amino or by acetylamino;

preferably copolymers containing from 1 to 50 mol % structural repeating units of formulae (7) and (8) and from 99 to 50 mol % structural repeating units of formulae (5) and (6), wherein $R_{11}$, $R_{12}$, $R_{13}$ and $R_{14}$ are each independently of the others as defined under (i) above, and w, x, y and z are integers equal to or greater than 1 or are the number 0, the condition Q=from 0.01 to 0.5 applying to the quotient $$Q = \frac{w+x}{w+x+y+z}.$$

The quotient Q is defined by the ratio of the structural units of formulae (7) and (8) to the total number of all structural units in the copolymer. The total number of all structural units in the copolymer is derived from the sum of the structural units of the formulae (7), (8), (5) and (6).

Preferably, the homo- or co-polymers defined in detail under (ii) above contain from 1 to 25 mol % structural repeating units of formulae (7) and (8) and from 99 to 75 mol % structural repeating units of formulae (5) and (6), the condition Q=from 0.01 to 0.25 applying to the quotient Q.

It is also possible to use mixtures of several of the afore-mentioned homo- or co-polymers as fixing agents.

The homo- or co-polymers used as fixing agents have an average molecular weight of from 1 000 to 1 000 000, preferably from 1 000 to 500 000 and especially from 5 000 to 200 000.

The present invention relates also to homo- or co-polymers comprising structural units of formula (7). The polymers according to the invention can be prepared as described above.

The preparation of the polymers used as fixing agents or of the polymers according to the invention, comprising structural units of formula (7), is effected in a manner known per se, for example by polymerisation, initiated ionically or preferably by free radicals, of the appropriate monomers, e.g. in solution, suspension or emulsion, and optionally subsequent hydrolysis. The polymerisation is effected preferably in solution using a peroxide, persulfate or an azo compound, for example using potassium persulfate or azo-bis(2-amidinopropane)hydrochloride, as a free-radical chain initiator, the latter being present, for example, in an amount of from 0.005 to 10% by weight, based on the monomers used. If the polymerisation is followed by a hydrolysis step, that step is carried out under alkaline or preferably acidic conditions. In the case of acidic hydrolysis there are obtained predominantly polymers having structural units of the afore-mentioned formula (2) wherein $R_5$ is hydrogen.

The homo- or co-polymer used according to the invention as fixing agent is used, irrespective of the liquor ratio, e.g. in an amount of from 0.05 to 10% by weight, preferably from 0.2 to 4% by weight, and especially from 0.5 from 2% by weight, active ingredient content, based on the weight of the polyamide fibre material.

The treatment of the polyamide fibre material with the fixing agent can be carried out before, during or, preferably, after dyeing. The method according to the invention is advantageously carried out by first dyeing the polyamide fibre material in customary manner and then carrying out an aftertreatment with a fresh aqueous liquor comprising the fixing agent in the aforementioned amount. The dyed polyamide fibre material can then be hydroextracted without a further rinsing operation and dried in customary manner. The afterfixing is generally carried out in fresh liquor. It is also possible, however, to carry out the afterfixing directly in the dye bath, provided that the dye bath is largely exhausted at the end and is still sufficiently acidic. The fixing is generally followed by brief cold rinsing with water.

Suitable polyamide fibre material is natural polyamide fibre material, e.g. wool or silk, or synthetic polyamide fibre material, e.g. polyamide 6 or polyamide 6.6, or fibre mixtures, e.g. wool/cellulose or polyamide/cellulose blends or polyamide/wool blends.

The textile material can be used in any form, e.g. in the form of fibres, yarn, woven fabrics or knitted fabrics.

The dyeings are made, for example, using anionic dyes, there being suitable any customary anionic dyes, as described, for example, in Colour Index, 3rd edition (1971) and the supplements thereto under the headings "Acid Dyes" or in the patent specifications U.S. Pat. No. 5,725,606, U.S. Pat. No. 5,691,459, U.S. Pat. No. 5,650,497, U.S. Pat. No. 5,630,851, U.S. Pat. No. 5,527,889, U.S. Pat. No. 5,234,467, U.S. Pat. No. 5,131,919, U.S. Pat. No. 5,094,665, U.S. Pat. No. 5,092,905 and U.S. Pat. No. 2,844,597.

Examples are sulfo-group-containing monoazo, polyazo, metal complex azo, anthraquinone, phthalocyanine and formazan dyes.

The anionic dyes used for dyeing the polyamide fibre material are either in the form of their free sulfonic acid or preferably in the form of their salts.

Salts that come into consideration are, for example, the alkali metal, alkaline earth metal or ammonium salts or the salts of an organic amine. Examples that may be mentioned are the sodium, lithium, potassium or ammonium salts or the salt of the mono-, di- or tri-ethanolamine.

The anionic dyes used for dyeing the polyamide fibre material may comprise further additives, for example sodium chloride or dextrin.

The dyeing of the polyamide fibre material with anionic dyes can be carried out in accordance with the dyeing or printing processes customary for those dyes, for example in accordance with the exhaust process. In addition to water and the dyes, the dye liquors or print pastes may comprise further additives, for example wetting agents, anti-foams, levelling agents or agents that influence the properties of the textile material, for example softeners, additives for flame-resistant finishes or dirt-, water- and oil-repellants and also water-softeners and natural or synthetic thickeners, e.g. alginates and cellulose ethers.

The amounts in which anionic dyes are used in the dye baths or print pastes can vary within wide limits depending upon the desired depth of shade; generally amounts of from 0.01 to 15% by weight, especially from 0.01 to 10% by weight, based on the material to be dyed or the print paste, have proved advantageous.

Preferably the dyeing with anionic dyes is carried out at a pH value of from 3 to 7, especially from 4 to 7. The liquor ratio can be selected within a wide range, e.g. from 1:5 to 1:50, preferably from 1:5 to 1:30. The dyeing is preferably carried out at a temperature of from 70 to 110° C., especially from 80 to 105° C.

The aftertreatment is carried out preferably in accordance with the exhaust process. The liquor ratio can be selected within a wide range and is e.g. from 1:4 to 1:100, preferably from 1:10 to 1:40 and especially from 1:5 to 1:40.

Special apparatus is not necessary. It is possible to use, for example, the customary dyeing apparatus, e.g. open baths, winch becks, jiggers or paddle, jet or circulatory apparatus.

The operation is advantageously carried out at a temperature of, for example, from 20 to 100° C. and preferably from 30 to 80° C. The treatment time can be, for example, from 10 to 60 minutes and preferably from 15 to 40 minutes; even in the case of dark shades, for example black dyeings, 15 minutes at 75° C. are sufficient. The pH value of the liquor is generally from 4 to 10, preferably from 5 to 7 and especially from 4.5 to 6.

In addition to the fixing agent, the liquor may also comprise further customary additives, e.g. electrolytes, such as sodium chloride or sodium sulfate, dispersants and wetting agents and antifoams.

The present invention relates also to the use of the method described above in improving the fastness to ozone of dyeings on natural or synthetic polyamide fibre materials.

In accordance with the method of the invention there are obtained dyeings or prints of dyes, e.g. anionic dyes, on polyamide fibre material that exhibit a considerable improvement in their fastness to ozone and fastness to wetting, e.g. fastness to washing and to water and especially fastness to chlorine, without the colour yield, shade or the fastness to light being adversely affected. In addition, the treated dyeings and prints do not exhibit any stiffening. On printed polyamide fibre material, contamination of the white ground is prevented.

The following Examples serve to illustrate the invention. The temperatures are given in degrees Celsius, parts are parts by weight and percentages relate to percent by weight, unless otherwise indicated. Parts by weight relate to parts by volume in a ratio of kilograms to liters.

PREPARATION EXAMPLES

Example 1

60 parts of vinylformamide and 60 parts of deionised water are placed in a reactor and heated under nitrogen to approximately 70° C. Then a solution of 1.8 parts of sodium persulfate in 12 parts of water is added dropwise within a period of 90 minutes. Postpolymerisation is then effected for 6 hours at 75° C. A solution of 83 parts of 37% hydrochloric acid in 90 parts of water is then added and the mixture is heated at about 80° C. for 4 hours. After establishment of an active content of 20%, a slightly viscous, clear polymer solution is obtained, the active principle of which is in hydrochloride form and comprises essentially structural units of formulae (101)

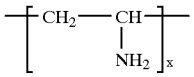

and (102)

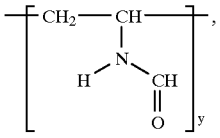

the value Q (x/x+y) being approximately 0.8.

Example 2

135 parts of a 17.5%, hydrolysed polyvinylformamide solution (degree of hydrolysis about 80%) are neutralised to pH 9.5. After the addition of 0.5 part of benzyltrimethylammonium hydroxide and 2.4 parts of vinylsulfonyl-4-aminobenzene, the mixture is heated at about 70° C. for 2 hours. After adjustment of the pH to 6 and establishment of an active content of 20%, a slightly viscous, clear polymer solution is obtained, the active principle of which is partly in hydrochloride form and comprises essentially structural units of formulae (101), (102) and

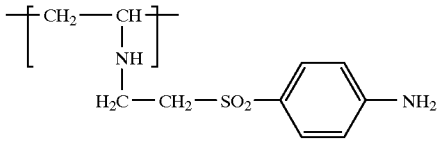

(103) having a viscosity of 2530 cP.

Example 3

21.3 parts of vinylformamide, 15.9 parts of acrylonitrile, 15.9 parts of a 30% acrylamide solution and 145 parts of water are placed in a reactor and heated under nitrogen to about 80° C. Then a solution of 1.45 parts of azo-bis (amidinopropane)hydrochloride in 10 parts of water is added dropwise within a period of 90 minutes. Postpolymerisation is then effected for 4 hours at 80° C. After the addition of 29.5 parts of 37% hydrochloric acid, the mixture is heated at about 80° C. for a further 4 hours. After establishment of an active content of 20%, a slightly viscous, clear polymer solution is obtained, the active principle of which is in hydrochloride form and comprises essentially structural units of formulae (104)

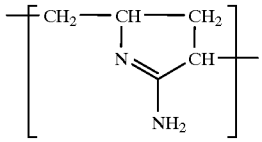

and (105)

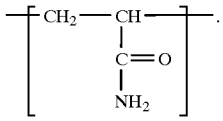

Example 4

14.2 parts of vinylformamide, 11.4 parts of 3-(N-vinylformamido)propionic acid ethyl ester and 50 parts of water are placed in a reactor and heated under nitrogen to about 70° C. Then a solution of 0.5 part of azo-bis (amidinopropane)hydrochloride in 10 parts of water is added dropwise within a period of 60 minutes. Postpolymerisation is then effected for 6 hours at 70° C. After the addition of a solution of 27 parts of 37% hydrochloric acid in 40 parts of water, the mixture is heated at about 80° C. for a further 4 hours. After establishment of an active content of 20%, a slightly viscous, clear polymer solution is obtained, the active principle of which is present in hydrochloride form and comprises essentially structural units of formulae (101) and (106)

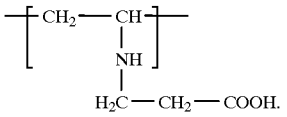

Example 5

111 parts of an 18% polyvinylamine hydrochloride solution (degree of hydrolysis about 80%) are adjusted to pH 10 with a NaOH solution. After the addition of 0.2 part of benzyltrimethylammonium chloride, the mixture is heated to 80° C. Then a solution of 58 parts of 1-chloro-2-dimethylaminoethane hydrochloride and 75 parts of water is added dropwise within a period of 2 hours. During the addition, the pH is maintained at about 9.5. After 5 hours at about 85° C., the pH value is adjusted to 2.5. The solution is concentrated, the salts are filtered and the polymer is precipitated in ethanol. Then a 33% aqueous solution of the polymer is prepared, the polymer comprising essentially structural units of formulae (101), (107)

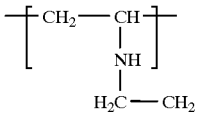

and (108)

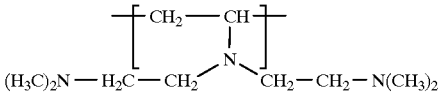

and being in hydrochloride form.

Example 6

150 parts of an 18% polyvinylamine hydrochloride solution (degree of hydrolysis about 85%) are adjusted to pH 10 with a NaOH solution. After the addition of 0.5 part of benzyltrimethylammonium chloride, the mixture is heated to 80° C. Then 23.3 parts of chloroethanol are added dropwise within a period of 3 hours. During the addition, the pH is maintained at about 9.5. After 5 hours at about 85° C., the pH value is adjusted to 2.5. The solution is concentrated and the polymer is precipitated in acetone. Then a 33% aqueous solution of the polymer is prepared, the polymer comprising essentially structural units of formulae (101) and

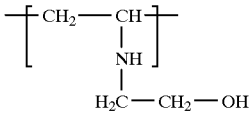

(109) and being in hydrochloride form.

Example 7

100 parts of an 18% polyvinylamine hydrochloride solution (degree of hydrolysis about 80%) are adjusted to pH 10 with a NaOH solution. Then a solution of 42.6 parts of 3-chloro-2-hydroxypropyl-trimethylammonium chloride in 42.6 parts of water is added dropwise within a period of 1 hour at about 75° C. During the addition, the pH is maintained at about 9.5. After 4 hours at about 80° C., the pH value is adjusted to 2. The solution is partially concentrated and the polymer is precipitated in ethanol. Then a 33% aqueous solution of the polymer is prepared, the polymer comprising essentially structural units of formulae (101) and

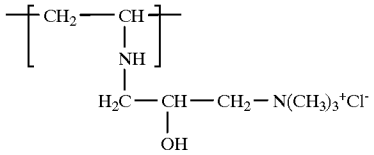

(110) and being in hydrochloride form.

Example 8

25.6 parts of vinylformamide, 20 parts of vinylpyrrolidone, 16.9 parts of vinylimidazole and 238 parts of water are placed in a reactor and heated under nitrogen to about 80° C. Then a solution of 1.6 parts of azo-bis (amidinopropane)hydrochloride in 10 parts of water is added dropwise within a period of 90 minutes. Postpolymerisation is then effected for 4 hours at 80° C. After the addition of 53 parts of 37% hydrochloric acid, the mixture is heated at about 95° C. for a further 4 hours. The polymer is precipitated in ethanol. A 20% aqueous solution of the polymer is then prepared, the polymer comprising essentially structural units of formulae (101), (111)

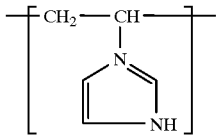

and

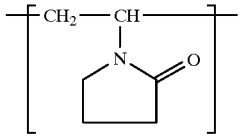

(112) and being in hydrochloride form.

Example 9

40 parts of 3-(N-vinylformamido)-propionitrile, 10.1 parts of vinylimidazole and 82 parts of water are placed in a reactor and heated under nitrogen to about 80° C. Then a solution of 0.95 part of azo-bis(amidinopropane) hydrochloride in 10 parts of water is added dropwise within a period of 90 minutes. Postpolymerisation is then effected for 4 hours at 80° C. After the addition of 42.3 parts of 37% hydrochloric acid, the mixture is heated at about 95° C. for a further 5 hours. The polymer is precipitated in ethanol. A 33% aqueous solution of the polymer is then prepared, the polymer comprising essentially structural units of formulae (111)

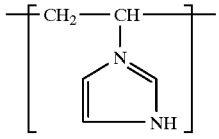

and

-continued (113)

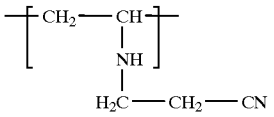

and being in hydrochloride form.

Example 10

45.3 parts of a 15%, hydrolysed polyvinylformamide solution (degree of hydrolysis about 85%) are diluted with 35 parts of water and neutralised to pH 8.5. After the addition of 0.1 part of benzyltrimethylammonium chloride and 45 parts of tetrahydrofuran, a solution of 3.6 parts of benzenesulfonyl chloride in 11 parts of tetrahydrofuran is added dropwise within a period of 15 minutes. The mixture is stirred at room temperature for a further 4 hours. After adjustment of the pH to 6.5, tetrahydrofuran is distilled off and the active content is adjusted to 15%. A turbid, slightly viscous polymer solution is obtained, the active principle of which is partly in hydrochloride form and comprises essentially structural units of formulae (101), (102) and (114)

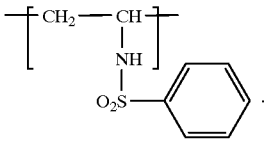

Example 11

45.3 parts of a 15%, hydrolysed polyvinylformamide solution (degree of hydrolysis about 85%) are diluted with 35 parts of water and neutralised to pH 8.5. After the addition of 0.1 part of benzyltrimethylammonium chloride and 45 parts of tetrahydrofuran, a solution of 2.8 parts of benzoyl chloride in 11 parts of tetrahydrofuran is added dropwise within a period of 15 minutes. The mixture is stirred at room temperature for a further 4 hours. After adjustment of the pH to 6.5, tetrahydrofuran is distilled off and the active content is adjusted to 15%. A turbid, slightly viscous polymer solution is obtained, the active principle of which is partly in hydrochloride form and comprises essentially structural units of formulae (101), (102) and (115)

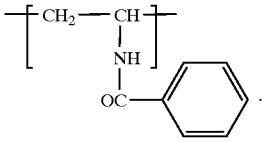

Example 12

45.3 parts of a 15%, hydrolysed polyvinylformamide solution (degree of hydrolysis about 85%) are diluted with 35 parts of water and neutralised to pH 10. After the addition of 60 parts of tetrahydrofuran, 3.1 parts of 4-acetaminobenzenesulfonyl chloride are added within a period of 5–10 minutes. The pH value is kept constant at 10. The mixture is stirred at room temperature for a further 2 hours. After adjustment of the pH to 6.5, tetrahydrofuran is distilled off and the active content is adjusted to 15%. A slightly turbid, moderately viscous polymer solution is obtained, the active principle of which is partly in hydrochloride form and comprises essentially structural units of formulae (101), (102) and (116)

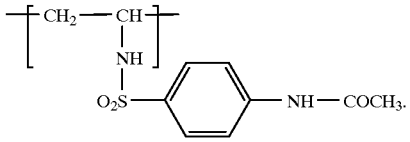

Example 13

75 parts of the polymer solution from Example 12 are diluted with 80 parts of water. After the addition of 13.2 parts of 37% hydrochloric acid, stirring is carried out at 95° C. for 6 hours. After adjustment of the pH to 7, the polymer solution is desalted and the active content is adjusted to 15%. A slightly turbid, viscous polymer solution is obtained, the active principle of which is partly in hydrochloride form and comprises essentially structural units of formulae (101), (102) and (117)

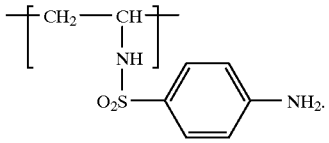

Example 14

80 parts of a 15%, hydrolysed polyvinylformamide solution (degree of hydrolysis about 85%) are diluted with 30 parts of water and neutralised to pH 9.5. After the addition of 0.5 part of benzyltrimethylammonium hydroxide, the mixture is heated to 70° C. Then within a period of 5–10 minutes a solution, neutralised to pH 4.5, of 3.5 parts of vinylsulfonyl-4-aminobenzene and 8 parts of water is added dropwise. The pH is kept constant at 9.5. The mixture is stirred at 70° C. for a further 2 hours. After adjustment of the pH to 7, the active content is adjusted to 15%. A clear, slightly viscous polymer solution is obtained, the active principle of which is partly in hydrochloride form and comprises essentially structural units of formulae (101), (102) and (103) having a viscosity of 1600 cP.

APPLICATION EXAMPLES

Example 15

100 g of a polyamide 6.6 textured tricot having a $m^2$ weight of 235 g are dyed in a laboratory beck with a liquor ratio of 1:20 using a liquor containing 1 g/l of ammonium acetate and 0.5 g/l of a commercially available levelling agent. For that purpose, the liquor is first adjusted to pH 5 with acetic acid and heated to 50° C. and the polyamide tricot is treated at that temperature for 10 minutes. Then 3.0 g/l of the dye of the formula

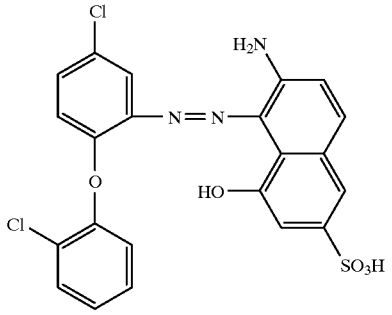

are added and the bath is maintained at 50° C. for a further 5 minutes. The dyeing temperature is then increased to 98° C. within a period of 30 minutes. The polyamide tricot is treated at that temperature for 60 minutes. The polyamide tricot is then rinsed with cold water and subjected to aftertreatment in a fresh bath containing 3.0 g/l of the polymer solution according to Example 1 with a liquor ratio of 1:20. For that purpose, the liquor is first adjusted to pH 4 with acetic acid and the dyed polyamide tricot is introduced into the fixing liquor at 25° C. and treated at that temperature for 10 minutes. The bath temperature is then increased to 75° C. within a period of 20 minutes and that temperature is maintained for a further 15 minutes. The dyed and afterfixed polyamide tricot is then rinsed briefly with cold water and dried at 60° C. The resulting dyeing has very good fastness to wetting, without the shade and the fastness to light being affected.

If the procedure described in Example 15 is followed, but instead of the polymer solution according to Example 1 there is used the equivalent amount by weight of one of the polymer solutions according to any one of Examples 2 to 14, there is again obtained a polyamide 6.6 textured tricot having improved fastness to wetting, without the shade and the fastness to light being affected.

Example 16

100 g of a polyamide 6 woven tricot having a $m^2$ weight of 120 g are dyed in a laboratory jet with a liquor ratio of 1:10 using a liquor containing 1 g/l of ammonium acetate and 0.5 g/l of a commercially available levelling agent. For that purpose, the liquor is first adjusted to pH 5.5 with acetic acid and heated to 40° C. and the woven tricot is treated at that temperature for 15 minutes. Then 0.6 g/l of the dye of the formula

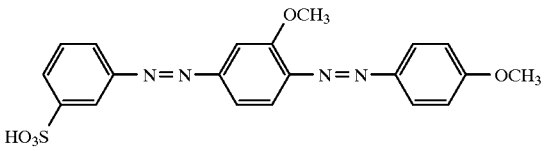

and 1.2 g/l of the dye of the formula

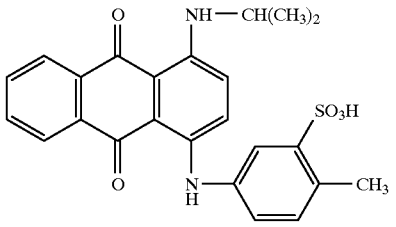

are added and the bath is maintained at 40° C. for a further 5 minutes. The dyeing temperature is then increased to 98° C. within a period of 30 minutes. The woven tricot is treated at that temperature for 60 minutes. The liquor is then cooled to 50° C. within a period of 15 minutes. For fixing, 1.5 g/l of the polymer solution according to Example 2 are added directly to the exhausted dye bath and the liquor is adjusted to pH 5 with acetic acid. The temperature of the liquor is then increased to 80° C. within a period of 15 minutes and maintained at that temperature for 10 minutes. The dyed and afterfixed woven tricot is then rinsed briefly with cold water and dried at 60° C. The resulting dyeing has very good fastness to wetting, without the shade and the fastness to light being affected.

If the procedure described in Example 16 is followed, but instead of the polymer solution according to Example 2 there is used the equivalent amount by weight of one of the polymer solutions according to any one of Examples 1 and 3 to 14, there is again obtained a polyamide 6 woven tricot having improved fastness to wetting, without the shade and the fastness to light being affected.

Example 17

A dye bath containing 600 parts of water, 0.0108 part of a dye of the formula

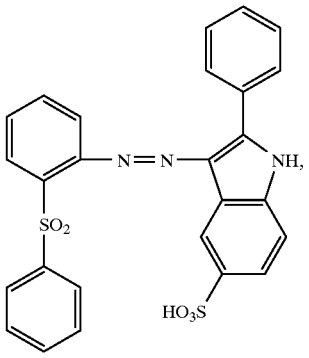

0.0135 part of a dye of the formula

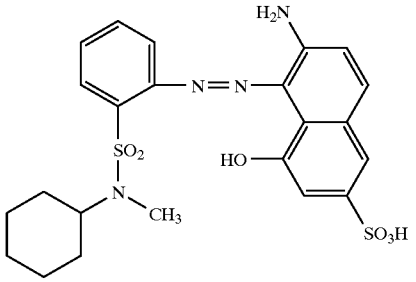

and 0.033 part of a dye of the formula

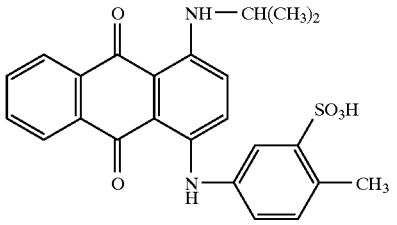

is adjusted to a pH of 6.5 with 0.72 part of sodium dihydrogen phosphate monohydrate and 0.6 part of disodium hydrogen phosphate dodecahydrate. 30 parts of polyamide woven carpet fabric (polyamide 6) are introduced into the dye bath at 30° C. The temperature is increased to boiling point uniformly within a period of 45 minutes and dyeing is then continued at that temperature for a further 30 minutes. The grey-dyed carpet is then rinsed. The dyed woven carpet fabric is subjected to aftertreatment for 15 minutes in a fresh bath of 600 parts of water, 3 parts of the polymer solution according to Example 2, 0.6 part of sodium acetate and 0.7 part of acetic acid at a pH of 4.5 and a temperature of 75° C. The woven carpet fabric is then rinsed and dried. The fastness to ozone of the resulting dyeing is tested in accordance with the ISO 105-G03 testing procedure. A comparison of the aftertreated woven carpet fabric with a woven carpet fabric that has not been subjected to aftertreatment shows a marked increase in the ozone resistance of the aftertreated woven carpet fabric.

What is claimed is:

1. A method of fixing dyes on natural or synthetic polyamide fibre materials, wherein the fibre material is treated, before, during or after dyeing, with a liquor comprising a homo- or co-polymer having structural repeating units of at least one of formulae (1), (2) and (3)

(1)

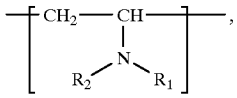

(2)

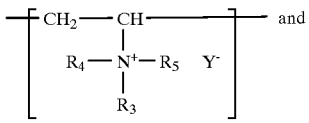

and

-continued (3)

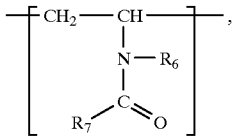

wherein $R_1$, $R_2$, $R_3$, $R_4$ and $R_6$ are each independently of the others hydrogen; $C_1$–$C_6$alkylsulfonyl; unsubstituted or substituted phenyl; benzoyl or phenylsulfonyl each unsubstituted or substituted in the phenyl ring; or a $C_1$–$C_{12}$alkyl radical that is unsubstituted or substituted by hydroxy, carboxy, cyano, carbamoyl, a radical —CONH-(alk)-T, N,N-di-$C_1$–$C_4$alkylcarbamoyl,

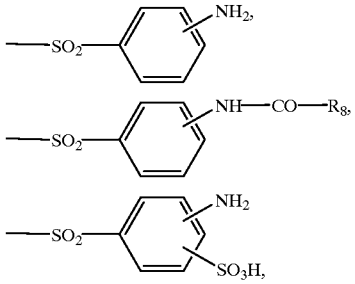

amino or by a radical —$NHR_9$, —$N(R_9)_2$, —$N(R_9)_3^+Y^-$ or —COO-(alk)-T, (alk) is a straight-chain or branched $C_1$–$C_{10}$alkylene radical, T is hydrogen or a radical —$NH_2$, —$NHR_9$, —$N(R_9)_2$ or —$N(R_9)_3^+Y^-$, $R_8$ and $R_9$ are $C_1$–$C_6$alkyl and $Y^-$ is an anion, $R_5$ is hydrogen or benzyl or has one of the meanings indicated above for $R_1$, $R_2$, $R_3$, $R_4$ and $R_6$ as a $C_1$–$C_{12}$alkyl radical, and $R_7$ is hydrogen or $C_1$–$C_4$alkyl, with the exclusion of a homopolymer having structural repeating units of the formula (1) wherein $R_1$ and $R_2$ are each hydrogen.

2. A method according to claim 1, wherein $R_1$, $R_2$, $R_3$, $R_4$ and $R_6$ are each independently of the others hydrogen; phenyl that is unsubstituted or substituted by halogen, sulfo, $C_1$–$C_4$alkyl, $C_1$–$C_4$alkoxy, amino or by $C_2$–$C_4$alkanoylamino; benzoyl or phenylsulfonyl each unsubstituted or substituted in the phenyl ring by halogen, $C_1$–$C_4$alkyl, $C_1$–$C_4$alkoxy, amino or by $C_2$–$C_4$alkanoylamino; or a $C_1$–$C_6$alkyl radical that is unsubstituted or substituted by hydroxy, carboxy, cyano, carbamoyl, a radical —CONH-(alk)-T, N,N-di-$C_1$–$C_4$alkylcarbamoyl,

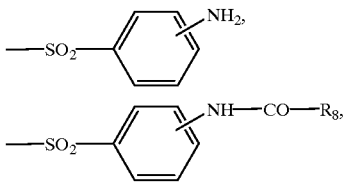

-continued

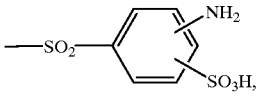

amino or by a radical —$NHR_9$, —$N(R_9)_2$, —$N(R_9)_3^+Y^-$ or —COO-(alk)-T, wherein (alk) is $C_1$–$C_4$alkylene, T is as defined in claim 1, $R_8$ and $R_9$ are $C_1$–$C_4$alkyl and $Y^-$ is a halide anion.

3. A method according to claim 1, wherein $R_1$, $R_2$, $R_3$, $R_4$ and $R_6$ are each independently of the others hydrogen; phenyl that is unsubstituted or substituted by halogen, $C_1$–$C_4$alkyl or by $C_1$–$C_4$alkoxy; benzoyl or phenylsulfonyl each unsubstituted or substituted in the phenyl ring by $C_1$–$C_4$alkyl, $C_1$–$C_4$alkoxy, amino, acetylamino or by propionylamino; or a $C_1$–$C_4$alkyl radical that is unsubstituted or substituted by hydroxy, carboxy, cyano, a radical —CONH—$(CH_2)_{1-3}$-T,

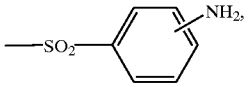

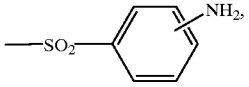

amino or by a radical —$NHR_9$, —$N(R_9)_2$, —$N(R_9)_3^+Y^-$ or —COO—$(CH_2)_{1-3}$-T, wherein T is as defined in claim 1, $R_9$ is methyl or ethyl and $Y^-$ is a halide anion.

4. A method according to claim 1, wherein $R_1$, $R_2$, $R_3$, $R_4$ and $R_6$ are each independently of the others hydrogen; phenyl; benzoyl or phenylsulfonyl each unsubstituted or substituted in the phenyl ring by methyl, ethyl, amino or by acetylamino; methyl; ethyl; hydroxy-$C_1$–$C_2$alkyl; carboxy-$C_1$–$C_2$alkyl; cyano-$C_1$–$C_3$alkyl;

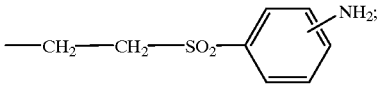

$(R_9)_2N$—$C_1$–$C_3$alkyl; $Y^-(R_9)_3N^+$-$C_1$–$C_3$alkyl; or a radical of formula —$CH_2$—CH(OH)—$(CH_2)_{1-2}$-T, (4a)

—$CH_2$—CH($R_{10}$)—COO—$(CH_2)_{1-3}$-T, (4b)

or

—$CH_2$—CH($R_{10}$)—CONH—$(CH_2)_{1-3}$-T (4c), wherein

T is hydrogen, —$N(R_9)_2$ or —$N(R_9)_3^+Y^-$, $R_9$ is methyl or ethyl, $R_{10}$ is hydrogen or methyl and $Y^-$ is a bromide or chloride anion.

5. A method according to claim 1, wherein $R_1$ , $R_2$, $R_3$, $R_4$ and $R_6$ are each independently of the others hydrogen, benzoyl, phenylsulfonyl, 4-aminophenylsulfonyl, 4-acetylaminophenylsulfonyl, —$CH_2$—$CH_2$—COO—$(CH_2)_{1-2}$—$CH_3$, —$CH_2$—$CH_2$—COOH, —$CH_2$—$CH_2$—OH, —$CH_2$—$CH_2$—CN,

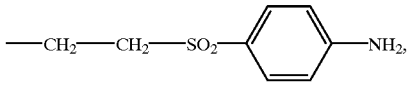

—$CH_2$—$CH_2$—$N(CH_3)_2$ or —$CH_2$—$CH_2$—$N^+(CH_3)_3Y^-$, wherein $Y^-$ is a bromide or chloride anion.

6. A method according to claim 1, wherein $R_2$ and $R_4$ are hydrogen.

7. A method according to claim 1, wherein $R_5$ is hydrogen, benzyl or $C_1$–$C_4$alkyl.

8. A method according to claim 1, wherein $R_1$, $R_3$ and $R_6$ are each independently of the others hydrogen, benzoyl, phenylsulfonyl, 4-aminophenylsulfonyl, 4-acetylaminophenylsulfonyl, —$CH_2$—$CH_2$—COO—$(CH_2)_{1-2}$—$CH_3$, —$CH_2$—$CH_2$—COOH, —$CH_2$—$CH_2$—OH, —$CH_2$—$CH_2$—CN,

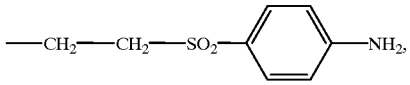

—$CH_2$—$CH_2$—$N(CH_3)_2$ or —$CH_2$—$CH_2$—$N^+(CH_3)_3Y^-$, wherein $Y^-$ is a bromide or chloride anion, and $R_2$ and $R_4$ are hydrogen, and $R_5$ is hydrogen, benzyl or $C_1$–$C_4$alkyl.

9. A method according to claim 1, wherein the homo- or co-polymer comprises structural repeating units of at least one of formulae (1) and (2), wherein $R_1$, $R_2$, $R_3$, $R_4$, $R_5$ and $Y^-$ are as defined in claim 1.

10. A method according to claim 1, wherein the homo- or co-polymer contains from 5 to 100 mol % structural repeating units of formulae (1a) and (1b)

(1a)

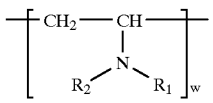

and (1b)

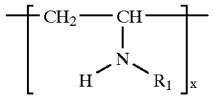

and from 95 to 0 mol % structural repeating units of formulae (5) and (6)

(5)

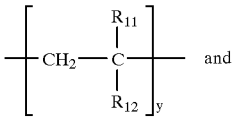

and (6)

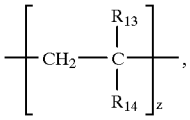

$R_1$ and $R_2$ are as defined in claim 1, $R_{11}$ and $R_{13}$ are each independently of the other hydrogen or methyl and $R_{12}$ and $R_{14}$ are each independently of the other pyrrolidonyl, amino, N-methylamino, N-ethylamino, —NH—CHO, —NH—CO—$CH_3$, —N($CH_3$)—CHO, —N($CH_3$)—CO—$CH_3$, —N($C_2H_5$)—CO—$CH_3$, imidazolyl, —O—CO—$CH_3$, —CO—$NH_2$, —CO—NH($CH_3$) or —CO—N($CH_3$)$_2$ and w, x, y and z are integers equal to or greater than 1 or are the number 0, the condition Q=from 0.05 to 1 applying to the quotient $$Q = \frac{w+x}{w+x+y+z}.$$

11. A method according to claim 10, wherein $R_1$ and $R_2$ are each independently of the other hydrogen, methyl, ethyl, hydroxy-$C_1$–$C_2$alkyl, carboxy-$C_1$–$C_2$alkyl, cyano-$C_1$–$C_3$alkyl, $(R_9)_2N$—$C_1$–$C_3$-Alkyl, $Y^-(R_9)_3N^+$—$C_1$–$C_3$-Alkyl, or a radical of formula —$CH_2$—CH(OH)—$(CH_2)_{1-2}$-T, (4a)

—$CH_2$—CH($R_{10}$)—COO—$(CH_2)_{1-3}$-T, (4b)

or

—$CH_2$—CH($R_{10}$)—CONH—$(CH_2)_{1-3}$-T (4c), wherein

T is hydrogen, —N($R_9$)$_2$ or —N($R_9$)$_3^+Y^-$, $R_9$ is methyl or ethyl, $R_{10}$ is hydrogen or methyl and $Y^-$ is a bromide or chloride anion.

12. A method according to claim 10, wherein $R_1$ and $R_2$ are each independently of the other hydrogen, —$CH_2$—$CH_2$—COO—$(CH_2)_{1-2}$—$CH_3$, —$CH_2$—$CH_2$—COOH, —$CH_2$—$CH_2$—OH, —$CH_2$—$CH_2$—CN, —$CH_2$—$CH_2$—N($CH_3$)$_2$ or —$CH_2$—$CH_2$—$N^+$($CH_3$)$_3Y^-$ wherein $Y^-$ is a bromide or chloride anion.

13. A method according to claim 10, wherein $R_1$ and $R_2$ have identical meanings.

14. A method according to claim 10, wherein the homo- or co-polymer contains from 20 to 100 mol % structural repeating units of formulae (1a) and (1b) and from 80 to 0 mol % structural repeating units of formulae (5) and (6), the condition Q=from 0.2 to 1 applying to Q.

15. A method according to claim 1, wherein the homo- or co-polymer comprises structural repeating units of at least one of formulae (7) and (8)

(7)

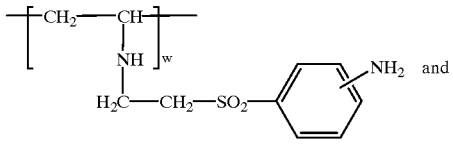

and (8)

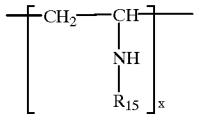

wherein $R_{15}$ is phenyl or is benzoyl or phenylsulfonyl each unsubstituted or substituted in the phenyl ring by methyl, ethyl, amino or by acetylamino.

16. A method according to claim 15, wherein the homo- or co-polymer is a copolymer containing from 1 to 50 mol % structural repeating units of formulae (7) and (8) and from 99 to 50 mol % structural repeating units of formulae (5) and (6)

(5)

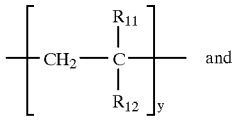

and (6)

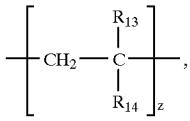

wherein $R_{11}$ and $R_{13}$ are each independently of the other hydrogen or methyl and $R_{12}$ and $R_{14}$ are each independently of the other pyrrolidonyl, amino, N-methylamino, N-ethylamino, —NH—CHO, —NH—CO—$CH_3$, —N($CH_3$)—CHO, —N($CH_3$)—CO—$CH_3$, —N($C_2H_5$)—CO—$CH_3$, imidazolyl, —O—CO—$CH_3$, —CO—$NH_2$, —CO—NH($CH_3$) or —CO—N($CH_3$)$_2$ and w, x, y and z are integers equal to or greater than 1 or are the number 0, the condition Q=from 0.01 to 0.5 applying to the quotient $$Q = \frac{w+x}{w+x+y+z}.$$

17. A method according to claim 1, wherein the homo- or co-polymer has an average molecular weight of from 1 000 to 1 000 000.

18. A method according to claim 1, wherein the homo- or co-polymer is present in the liquor in an amount of from 0.2 to 4% by weight active ingredient content, based on the weight of the polyamide fibre material.

19. A method according to claim 1, wherein the fibre material is treated after the dyeing.

20. A method according to claim 1, wherein the treatment with the liquor comprising the homo- or co-polymer is carried out in accordance with the exhaust process.

21. A method according to claim 1, for improving the fastness to ozone of dyeings and prints on natural or synthetic polyamide fibre materials.

* * * * *